US005704505A

United States Patent [19]

Singh

[11] Patent Number: 5,704,505

[45] Date of Patent: Jan. 6, 1998

[54] INFANT BOTTLE FEEDING SYSTEM

[76] Inventor: Hemchandre Singh, P.O. Box 11156, Charlotte Amalie, Virgin Islands (Br.), 00801

[21] Appl. No.: 693,902

[22] Filed: Aug. 5, 1996

[51] Int. Cl.[6] ..... A61J 9/00; A61J 9/06; A47D 15/00

[52] U.S. Cl. ..... 215/397; 215/11.1; 215/11.4; 248/104; 248/106; 5/655

[58] Field of Search ..... 215/11.1, 11.4, 215/11.5, 11.6, 395, 397; 248/102–106; 5/655, 101

[56] References Cited

U.S. PATENT DOCUMENTS

| | | | |
|---|---|---|---|
| 2,321,236 | 6/1943 | Parkin | 215/11.1 X |
| 2,499,930 | 3/1950 | Seiger | 248/103 |
| 2,803,251 | 8/1957 | White | 215/11.1 X |
| 3,269,621 | 8/1966 | Dishart | 5/655 X |
| 3,298,648 | 1/1967 | Sepanski | 248/103 |
| 3,620,491 | 11/1971 | Bacht | 248/106 |
| 4,034,945 | 7/1977 | Sato | 248/103 |
| 4,093,165 | 6/1978 | Sussman | 248/106 |
| 4,320,883 | 3/1982 | Bass | 248/104 |
| 4,463,859 | 8/1984 | Greene | 248/103 X |
| 4,685,577 | 8/1987 | Chen | 215/11.5 |
| 4,726,551 | 2/1988 | Randall et al. | 248/102 |
| 4,733,836 | 3/1988 | Barnes | 248/106 |
| 4,733,837 | 3/1988 | Aguirre | 248/106 |
| 4,750,696 | 6/1988 | Shan-Liang | 248/103 X |
| 4,898,060 | 2/1990 | To | 215/11.1 X |
| 4,944,704 | 7/1990 | Grace | 215/11.1 X |
| 5,037,046 | 8/1991 | Mingledorff, Jr. | 248/106 |
| 5,150,801 | 9/1992 | Held | 215/11.6 |
| 5,192,041 | 3/1993 | Bryant | 248/104 |
| 5,474,193 | 12/1995 | Larsson et al. | 215/11.4 |

FOREIGN PATENT DOCUMENTS

| | | | |
|---|---|---|---|
| 81698 | 9/1963 | France | 248/106 |
| 460274 | 1/1937 | United Kingdom | 215/11.4 |

*Primary Examiner*—Sue A. Weaver
*Attorney, Agent, or Firm*—David L. Volk

[57] ABSTRACT

An infant bottle feeding system is provided having a supported bottle holder for holding a feeding bottle. The bottle holder has a flat, elongated supporting base which can be placed underneath a supine infant for additional support. A flexible arm is retained by the supported base in an offset manner, thus allowing an infant roll to one side free of the base such that the infant is not trapped beneath the system. The flexible arm supports a bottle retaining clamp which holds a fluid storage vessel of the type conventionally used as infant feeding bottles. A flow restriction means is retained within a cap and away from the nipple, and both are then sealed to the opening of the storage vessel by the cap.

4 Claims, 3 Drawing Sheets

INFANT BOTTLE FEEDING SYSTEM

BACKGROUND OF THE INVENTION

1. Field of the Invention

The present invention relates generally to baby bottle holders and, more particularly, to a system for holding and feeding a bottle to an infant.

2. Description of the Related Art

As is well-known in the art, many baby bottle holders are known. For example, in U.S. Pat. No. 5,192,041, issued in the name of Bryant, a baby bottle holder is disclosed for supporting and infant's feeding bottle. Also, in U.S. Pat. No. 4,093,165, issued in the name of Sussman, a device for holding baby bottles is disclosed. However, both of the devices disclosed in these references are complicated, unstable, and unsafe for feeding a baby in that they can easily be knocked over by a baby's habitual jerky movements of the hands and feet. Moreover, feeding with such devices is restricted to a sitting position, which is not the preferred position for feeding either very young or older babies.

Also known is U.S. Pat. No. 3,620,491, issued in the name of Baclit, in which a nursing bottle holder is disclosed. However, as taught by the Baclit reference, a nursing bottle can be easily dislodged should the baby roll while feeding. Similar drawbacks are seen in U.S. Pat. No. 5,037,046, issued in the name of Mingledorff, Jr., and in U.S. Pat. No. 4,733,837, issued in the name of Aguirre. Moreover, as disclosed in the Mingledorff, Jr. and Aguirre references, a baby's movements are restricted, and can also be injurious to a baby should the infant move suddenly or unexpectedly.

Another problem occurs from the use of the types of devices taught in the related art in that safety consideration and modification of the feeding bottle itself are not addressed or considered.

Consequently, a need has been felt for providing a system for feeding an infant in a hands-free manner that is simple, easy to assemble, safe for the infant, and can prevent unnecessary spilling or choking due to unregulated fluid flow from the feeding bottle.

SUMMARY OF THE INVENTION

It is therefore an object of the present invention to provide an improved infant bottle holder.

It is yet another object of the present invention to provide an improved flow regulating infant feeding bottle for use with an infant bottle holder.

It is a feature of the present invention to provide an improved infant bottle holder which allows a baby to feed in the preferred position of lying down, while not restricting the baby's movements or allowing unrestricted fluid flow from the bottle.

Briefly described according to one embodiment of the present invention, an infant bottle feeding system is provided having a supported bottle holder for holding a feeding bottle. The bottle holder has a flat, elongated supporting base which can be placed underneath a supine infant for additional support. A flexible arm is retained by the supported base in an offset manner, thus allowing an infant roll to one side free of the base such that the infant is not trapped beneath the system. The flexible arm supports a bottle retaining clamp which holds a fluid storage vessel of the type conventionally used as infant feeding bottles. A nipple is held to against surface of a flow restriction means, and both are then sealed to the opening of the storage vessel by a cap.

An advantage of the present invention is that it is stabilized such as to prevent an infant from overturning the holder.

Another advantage of the present invention is that it allows an infant to feed in a flat, supine position.

Yet another advantage of the present invention is that the flow of fluid from the feeding bottle is governed, thereby preventing the possibility of both choking and/or excessive spillage.

Further, a preferred embodiment of the present invention incorporates a musical tone generate for providing auditory stimulation to an infant while feeding.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
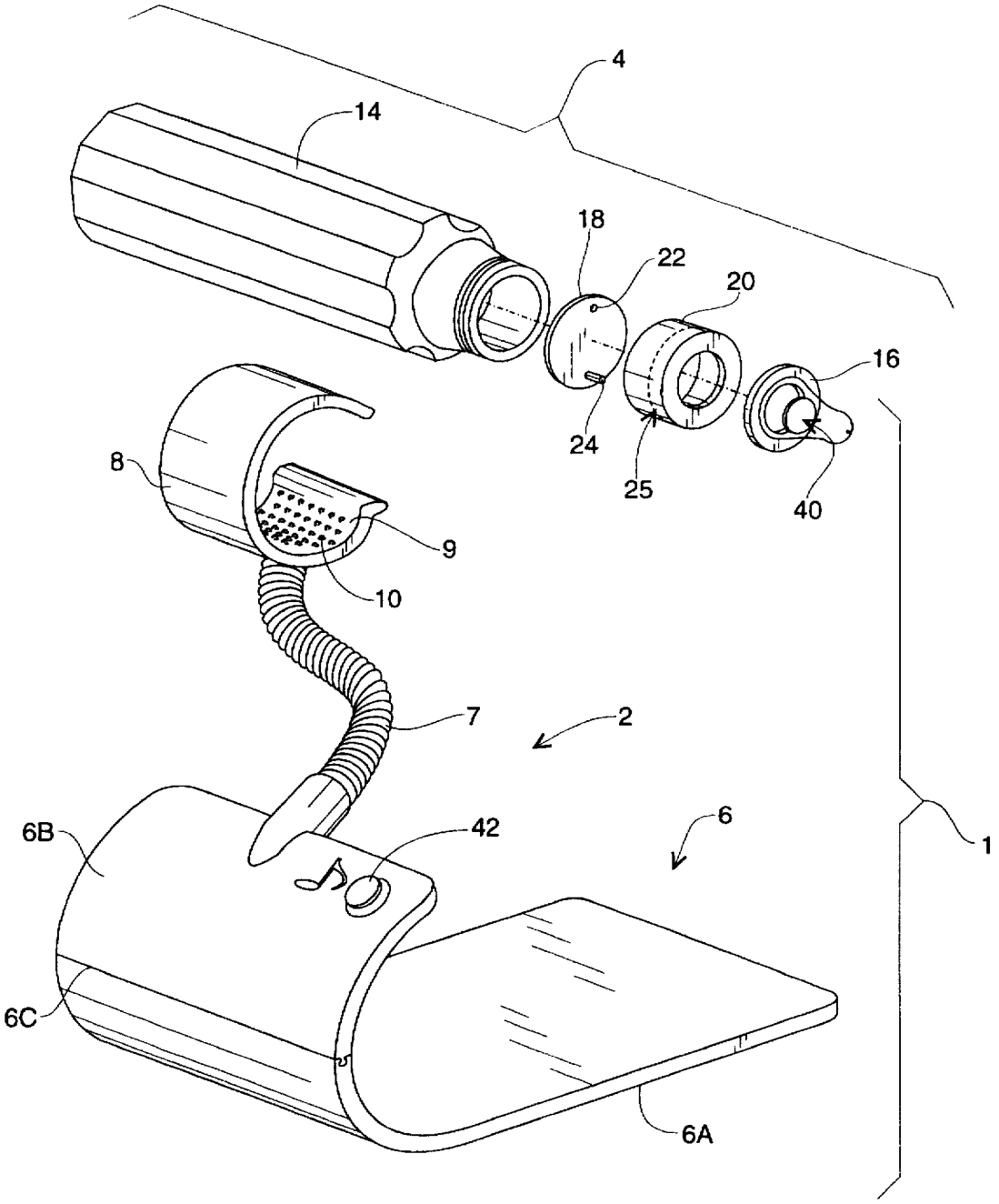
FIG. 1 is a perspective view of an infant bottle feeding system according to the preferred embodiment of the present invention.

Referring now to FIG. 1, an infant bottle feeding system 1 is shown, according to the present invention, having a supported bottle holder 2 for holding a feeding bottle 4. The bottle holder 2 has a flat, elongated supporting base 6 which can be placed underneath a supine infant for additional support. Although a one-piece embodiment is envisioned, in its preferred embodiment the supporting base 6 has a flat, lower section 6*a* which interlocks with an upper support section 6*b* along a sliding, interlock joint 6*c*. It is envisioned that the upper support section 6*b* can also include and support colorful storybook characters molded integrally therein, or other aesthetic diversions for providing visual interest. The upper support section 6*b* is connected to the lower section 6*a* along an outside edge of the lower section 6*a*, such that the upper support section 6*a* can retain a flexible arm 7 in an offset manner. This allows an infant to one side free of the base 6 such that the infant is not trapped beneath the system 1. The flexible arm 7 is envisioned as the type of bendable coil that is currently utilized with flexible neck lamps or other similar appliances. The flexible arm 7 supports a bottle retaining clamp 8. The feeding bottle 4 is retained within a generally "C" shaped clamping member of the bottle retaining clamp 8 by snapping the bottle 4 within the retaining clamp 8. In its preferred embodiment the retaining clamp 8 has an inner surface 9 aligned with raised gripping nodules 10 in order to increase the gripping force created by impingement between the inner surface 9 and the bottle 4. It is also envisioned that a number of minor modifications can be made to increase this gripping friction, such as cushioned material or resilient material lining the inner surface 9.

The infant feeding bottle 4 includes a fluid storage vessel 14 having an opening of the type conventionally used in infant feeding bottles. A nipple 16 is held against a surface of a flow restriction means 18; both are then sealed to the opening of the storage vessel by a cap 20. In the preferred embodiment, the flow restriction means 18 is shown as a flat disc incorporating a vent hole 22 penetrating the disc at a location near the outer perimeter, and a discharge funnel 24 penetrating the disc at a location near the outer perimeter and opposite the center point of the disc from the vent hole 22. A ridge 25 extends inward in a circumscribed manner from the inside surface of the cap 20, thereby providing a supporting and retaining structure for fitting the restrictor 18 against.

Figure 2A:
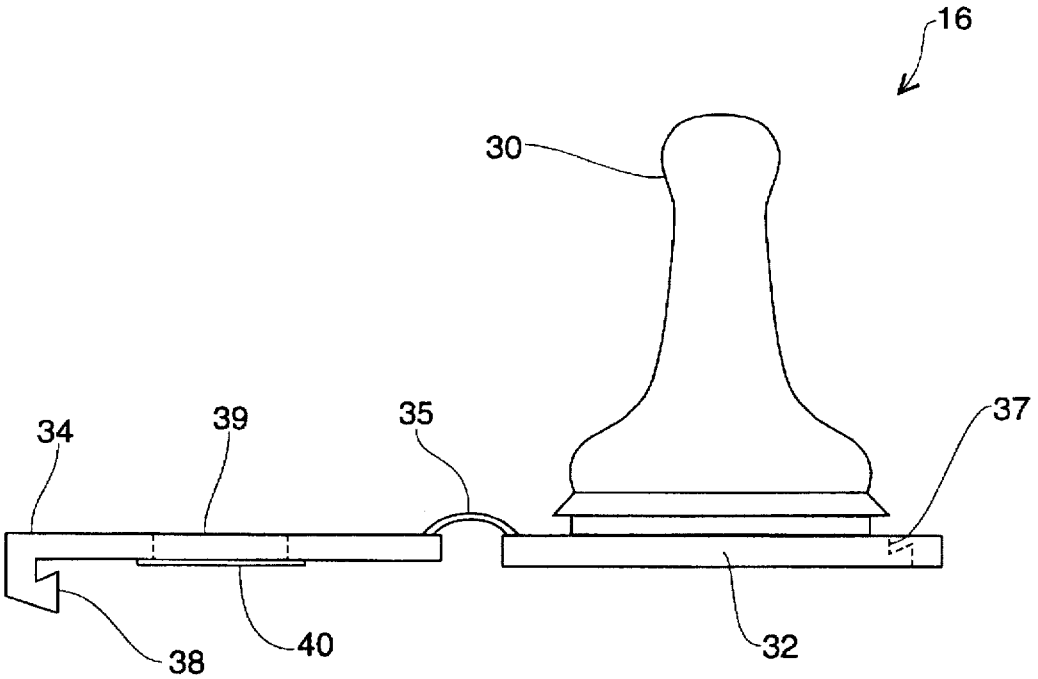
FIG. 2*a* is an elevational view of a nipple for use therewith showing the flow control means in an open configuration.
Figure 2B:
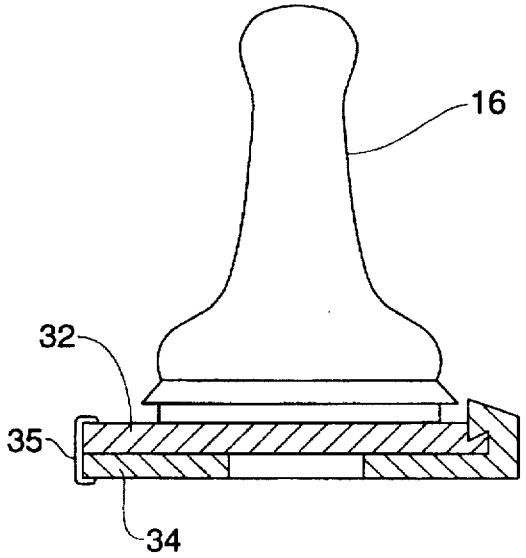
FIG. 2*b* is an elevational view thereof showing the flow control means in a closed configuration.
Figure 3:
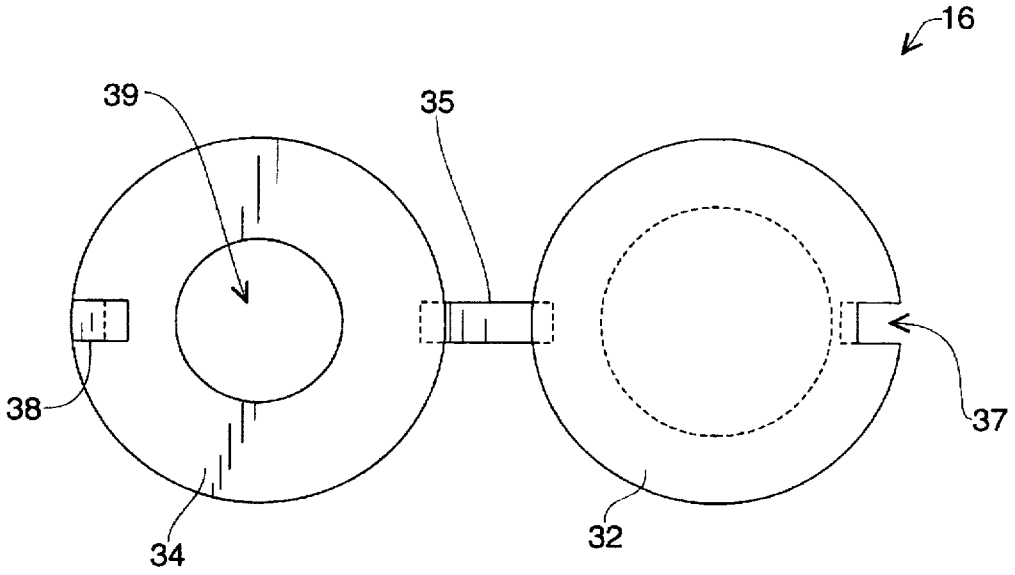
FIG. 3 is a bottom plan view of the nipple as shown in FIG. 2*a*.

Referring to FIG. 2*a* and FIG. 2*b*, the nipple 16 is shown in greater detail. The nipple 16 includes a generally conventional protrusion 30 formed extending from a sealing ring 32. An additional flange 34 is connected to the sealing ring 32 by a hinge 35. The sealing ring 32 formes a notch 37 opposite the hinge 35. As shown also in FIG. 3, the flange includes a catch hook 38 opposite the hinge 35 such that when the flange 34 is rotated about the hinge and pressed against the sealing ring 32, the catch hook 38 engages with the notch 37 in order to retain contact between the flange 34 and the sealing ring 32. Further, the flange 34 is an annular shape forming a center orifice 39. A one way valve 40 is attached to the flange 34, and covers the center orifice 39. The valve 40 operates to restrict the flow of fluid through the nipple 16 unless sufficient vacuum is formed to overcome the valve fluid resistance to flow.

2. Operation of the Preferred Embodiment

Figure 4:
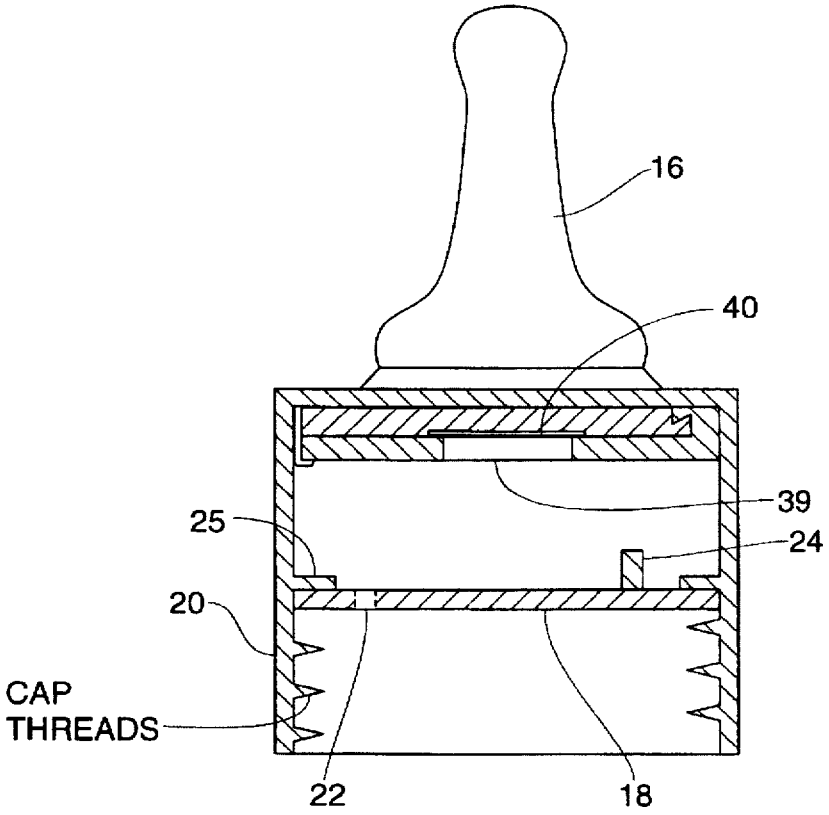
FIG. 4 is a cross sectional side elevation view of a cap, nipple, and restrictor assembly.

In operation, the present invention is utilized in order to provide liquid feeding to an infant in a hands-free manner. Before inserting the nipple 16 into the cap 20, as shown in FIG. 4, the catch hook 38 is clipped to the notch 37 by pressing them together with the thumb and forefinger. The nipple 16 is then inserted into the cap 20, and the restrictor 18 pressed into the cap 20 against ridge 25. After the fluid storage vessel 14 is filled, the cap 20 can then be attached in an otherwise conventional manner by threadingly engaging the cap 20 onto the vessel 14. The infant can then be placed on the base 6*b* of the bottle holder 2, and the feeding bottle 4 attached to the clamp 8 by snapping it into place. The flexible arm 7 can then be adjusted into a suitable position to feed a baby.

The foregoing description is included to illustrate the operation of the preferred embodiment and is not meant to limit the scope of the invention. Many modification can be made by one skilled in the relevant art within the teachings of the present disclosure. By way of example and not by limitation, a music generating means 42 for providing audible entertainment for a feeding infant, as depicted in FIG. 1, can be incorporated within the base 6. Other similar modifications are apparent; therefore the scope of the invention is to be limited only by the following claims.

What is claimed is:

1. An infant feeding system comprising:

a. a base having a generally planar lower section adapted to be placed beneath a supine infant;

b. the lower section curving at one end only, substantially along the entire end to form a single, upwardly extended, c-shaped support, at least a portion of the c-shaped support extending inwardly over the lower section when the lower section is positioned horizontally;

c. a joint positioned longitudinally along the c-shaped support and configured to permit a distal portion of the c-shaped support to be slidingly separated from the base;

d. a flexible arm extending outwardly from the distal portion of the c-shaped support;

e. an infant bottle holding means at a distal end of the flexible arm; and f. an infant bottle having a nipple and cap assembly, the infant bottle configured to be held by the infant bottle holding means.

2. The infant feeding system of claim 1, wherein the nipple and cap assembly comprises a flow restrictor and a one-way valve.

3. The infant feeding system of claim 1, wherein the infant bottle holding means comprises a c-shaped elongated clamp including raised gripping nodules on an inner surface of the clamp.

4. The infant feeding system of claim 1, further including a music generating means disposed on the c-shaped support.

* * * * *